US011486632B2

(12) United States Patent
Feldmeyer et al.

(10) Patent No.: US 11,486,632 B2
(45) Date of Patent: Nov. 1, 2022

(54) DOMESTIC REFRIGERATION DEVICE WITH A DRAWER, AND METHOD FOR PRODUCING THE DOMESTIC REFRIGERATION DEVICE

(71) Applicant: BSH HAUSGERAETE GMBH, Munich (DE)

(72) Inventors: Andreas Feldmeyer, Lauchheim (DE); Simon Kraemer, Aalen (DE); Sandra Oefele, Giengen (DE); Bernd Osbar, Aalen (DE); Daniel Wengert, Heidenheim (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/978,830

(22) PCT Filed: Feb. 28, 2019

(86) PCT No.: PCT/EP2019/055031
§ 371 (c)(1),
(2) Date: Sep. 8, 2020

(87) PCT Pub. No.: WO2019/170520
PCT Pub. Date: Sep. 12, 2019

(65) Prior Publication Data

US 2020/0408462 A1 Dec. 31, 2020

(30) Foreign Application Priority Data

Mar. 6, 2018 (DE) ..... 102018203272.6

(51) Int. Cl.
*F25D 25/02* (2006.01)
*F25D 23/02* (2006.01)
*F25D 29/00* (2006.01)

(52) U.S. Cl.
CPC ..... *F25D 25/025* (2013.01); *F25D 23/028* (2013.01); *F25D 29/005* (2013.01)

(58) Field of Classification Search
CPC .... F25D 25/025; F25D 23/028; F25D 29/005; F25D 23/021; F25D 2400/361; G06F 3/04847
See application file for complete search history.

(56) References Cited

U.S. PATENT DOCUMENTS 9,523,532 B2 12/2016 Delgadillo
10,480,847 B2 11/2019 Heisswolf et al.
(Continued)

FOREIGN PATENT DOCUMENTS

CN 205606979 U 9/2016
CN 205788916 U 12/2016
(Continued)

OTHER PUBLICATIONS

English translation for CN205606979 (Year: 2016).*

*Primary Examiner* — Hiwot E Tefera
(74) *Attorney, Agent, or Firm* — Laurence A. Greenberg; Werner H. Stemer; Ralph E. Locher

(57) ABSTRACT

A household refrigeration appliance includes a thermally insulated body or carcass which delimits a coolable interior, a refrigeration device for cooling the coolable interior space, a drawer which has a front panel, and a display provided on the front panel. The front panel includes a front side pointing away from the coolable interior space, a rear side pointing towards the coolable interior space, a top front edge and a top rear edge. The top region of the front panel includes a first region which has a recessed grip open to the top and which extends between the top front edge and the top rear edge, and a second region which extends next to the first region and in which the display is provided in a depression.
(Continued)

The front panel includes a semitransparent cover. A method for producing a household refrigeration appliance is also provided.

19 Claims, 5 Drawing Sheets

(56) References Cited

U.S. PATENT DOCUMENTS

| | | | | |
|---|---|---|---|---|
| 10,677,522 | B1 * | 6/2020 | Stauffer | F25D 17/045 |
| 10,907,884 | B1 * | 2/2021 | Scorsim | F25D 29/005 |
| 2006/0202596 | A1 * | 9/2006 | Bauer | F25D 23/028 312/405 |
| 2011/0006655 | A1 * | 1/2011 | Seo | A47B 88/40 312/402 |
| 2011/0209493 | A1 | 9/2011 | Schenk et al. | |
| 2012/0138500 | A1 * | 6/2012 | Jeong | F25D 29/005 206/459.1 |
| 2014/0028166 | A1 * | 1/2014 | Park | F25D 25/025 312/237 |
| 2014/0145579 | A1 * | 5/2014 | Anderson | F25D 29/005 312/404 |
| 2014/0239010 | A1 * | 8/2014 | Hwang | F25D 23/126 222/23 |
| 2014/0300263 | A1 * | 10/2014 | Sung | F25D 23/028 312/404 |
| 2015/0300724 | A1 * | 10/2015 | Becke | F25D 23/026 312/405 |
| 2016/0188093 | A1 * | 6/2016 | Kim | F25D 29/005 345/173 |
| 2017/0292766 | A1 * | 10/2017 | Lee | F25D 17/065 |
| 2019/0078838 | A1 * | 3/2019 | Staud | F25D 11/02 |
| 2019/0113275 | A1 * | 4/2019 | Jorapur | F25D 23/066 |
| 2020/0284503 | A1 * | 9/2020 | Gerstmayr | F25D 29/005 |

FOREIGN PATENT DOCUMENTS

| | | | |
|---|---|---|---|
| DE | 102009027891 | A1 | 1/2011 |
| DE | 102015222732 | A1 | 5/2017 |
| EP | 3043475 | A1 | 7/2016 |
| WO | 2015015355 | A1 | 2/2015 |

* cited by examiner

DOMESTIC REFRIGERATION DEVICE WITH A DRAWER, AND METHOD FOR PRODUCING THE DOMESTIC REFRIGERATION DEVICE

BACKGROUND OF THE INVENTION

Field of the Invention

The invention relates to a household refrigeration appliance with a drawer and a method for producing the household refrigeration appliance.

U.S. Pat. No. 9,523,531 B2 discloses a household refrigeration appliance, which delimits a thermally-insulated body with several coolable interior spaces which are provided for the storage of foods. One of the coolable interior spaces is a freezer compartment with a drawer, which can be slid into the freezer compartment and can be pulled out from the freezer compartment at least partially. In the at least partially pulled-out state, the drawer can be loaded with food and the food can be removed. The drawer comprises a front panel which closes the freezer compartment when the drawer is in the slid-in state. The front panel comprises a front side which faces away from the freezer compartment and is provided with a handle. The household refrigeration appliance comprises an input device with an integrated display, which is fastened in the upwardly directed flank of the front panel. The input device is provided to adjust operating states of the freezer compartment and to display the same with the display.

SUMMARY OF THE INVENTION

The object of the present invention is to specify a household refrigeration appliance with an improved drawer assigned to a coolable interior space of the household refrigeration appliance having a display which is in particular part of an input/display device for adjusting and displaying at least one operating parameter assigned to the drawer.

The object of the invention is achieved by a household refrigeration appliance having a thermally-insulated body, which delimits a coolable interior space, a refrigeration device for cooling the coolable interior space, a drawer having a front panel, which can be slid into the coolable interior space and can be pulled out of the coolable interior space at least partially for loading and unloading food, and a display arranged on the front panel, wherein the front panel has a front side facing away from the coolable interior space, a rear side facing the coolable interior space, two side flanks, a top front edge and a top rear edge, in the slid-in state the drawer closes the coolable interior space, in its top region comprises a first region extending between the top front and the top rear edge with an upwardly opened recessed grip and a second region arranged adjacent to the first region and extending between the top front and the top rear edge, in which the display is arranged in a depression and which comprises a semitransparent cover, which covers the complete second region, through which appear the information contents displayed thereby when the display is in the switched-on state, and which comprises a surface which faces away from the display and runs at least partially flush with a surface of the first region.

The display is preferably part of an input/display device, with which an operating parameter of the coolable interior space assigned to the drawer can be adjusted and displayed. The operating parameter is e.g. the target and/or the actual temperature of the coolable interior space.

A further aspect of the invention relates to a method for producing the inventive household refrigeration appliance, having the following method steps:

- fastening the display or the input/display device to the semitransparent cover, and
- fastening the semi-transparent cover with a display fastened thereto or input/display device fastened thereto on the front panel, so that the display or the input/display device is arranged in the depression and the semi-transparent cover covers the second region completely.

The display or the input/display device is fastened in particular by means of a catch mechanism to the semitransparent cover. The semitransparent cover with the display fastened thereto or input/display device fastened thereto is preferably likewise fastened to the front panel by means of a catch mechanism.

The household refrigeration appliance accordingly comprises the thermally-insulated body which delimits the coolable interior space. The thermally-insulated body comprises in particular an insulating foam as thermal insulation.

The household refrigeration appliance comprises the drawer which is provided for the cool storage of food. The drawer comprises the front panel and can be slid into the coolable interior space in order to close the same. In the at least partially pulled-out state, the drawer can be loaded with food or the food can be removed from the drawer.

The coolable interior space is cooled by means of the refrigeration device. This is preferably configured as a refrigerant circuit essentially known to the person skilled in the art and is preferably designed in such a way that it cools the coolable interior space at least approximately to a predetermined temperature. The household refrigeration appliance can comprise an electronic control device, which controls or regulates the refrigeration device in the manner essentially known to the person skilled in the art.

The inventive household refrigeration appliance can be a household freezer appliance, for instance. In this case the coolable interior space is cooled to temperatures clearly below 0° C. The inventive household refrigeration appliance can be a household refrigerator, for example. In this case the coolable interior space is cooled to temperatures of 10° C., for example. The inventive household refrigeration appliance can however also be a refrigerator-freezer. The inventive household refrigeration appliance can have precisely one coolable interior space but also several coolable interior spaces, each of which can also be closed and opened by means of a drawer. The household refrigeration appliance can additionally also comprise at least one coolable interior space, which can be closed by means of a door leaf.

The inventive household refrigeration appliance can also be embodied as a wine cooler, which is provided to store bottles filled with drinkable liquids, in particular wine, as food.

The drawer comprises the front panel, which is preferably thermally-insulated, e.g. by means of an insulating foam. The front panel comprises the front side, which faces away from the coolable interior space, the rear side which faces the coolable interior space, two side flanks, the top rear edge and the top front edge. The front side extends as far as the top front edge and rear side extends as far as the top rear edge. The edges can be rounded.

In its top region the front panel comprises the first region which has a recessed grip which is open to the top and the second region which is arranged next to the first region.

The first and the second region can be separated from one another by means of a wall.

The first region comprises the recessed grip which is open to the top and which extends in particular as far as the top front edge.

The recessed grip preferably comprises a front and rearwardly engageable wall section which extends as far as the top front edge of the front panel and a recessed grip section which passes into the rearwardly engageable wall section and runs in an oblique manner. The recessed grip section which runs in an oblique manner can run in a planar manner or also be designed to be curved. The recessed grip preferably runs as far as the second region.

The second region is arranged adjacent to the first region. This extends between the top rear edge and the top front edge and preferably as far as one of the side flanks of the front panel. The first region and preferably the recessed grip extend preferably as far as the other side flank, so that in particular the first and the second region form a complete flank of the front panel which is directed upward.

The second region comprises the depression, in which the display, in particular the input/display device is arranged, in particular fastened, preferably fastened in the depression by means of a catch mechanism.

The second region is completely covered by the semitransparent cover. The surface of the semitransparent cover facing away from the display or the input/display device therefore forms the surface of the second region. This surface runs at least partially flush with the surface of the first region. As a result, this means that the geometry/contour of the grip region, i.e. of the first region, passes in a fluid manner into the second region or its semitransparent cover.

The depression is, for instance, embodied as a pocket and/or as a reinforcing part which is foamed in the possibly existing insulating foam.

The semitransparent cover is preferably fastened to the display or the input/display device, in particular by means of a catch mechanism.

The semitransparent cover with display fastened thereto or input/display device fastened thereto is fastened to the front panel preferably by means of a catch mechanism. As a result, it is relatively easily possible to remove the semitransparent cover, in order to replace e.g. the display, possibly the input/display device.

A sealing ring for protecting the display or the input/display device from humidity can be provided between the semitransparent cover and the display or the input/display device.

The input/display device is preferably designed as a touchscreen, which preferably comprises a "slider" function. Provision can also be made to provide a time lapse display with "fade in/out" of LEDs arranged in a light line.

The first region and the recessed grip extend in particular with respect to the width of the front panel across a clearly wider region than the second region, in order to provide as large a recessed grip as possible. In particular, the first region and the recessed grip extends across a large part of the width of the front panel.

The semitransparent cover and the recessed grip or the first region are preferably manufactured from two different materials. The first region or the recessed grip are e.g. lacquered.

The semi-transparent cover is manufactured from polymethylmethacrylate, for instance. In order to obtain the semitransparent properties, the semitransparent cover is e.g. printed or provided with a film. The surface of the semitransparent cover facing the display, or the input/display device is preferably printed or provided with the film, in order to obtain the semitransparent property of the semitransparent cover.

Preferably not only at least one part of the surface of the second region runs flush with the surface of the first region, but the colors of these regions are instead also matched with one another. This can be realized relatively easily by selecting the color of the printing or the film of the semitransparent cover. It is then possible that although the semitransparent cover and the recessed grip or the first region are preferably produced from different materials, there is visually no or at least hardly any visible difference between the two regions.

According to a preferred embodiment of the inventive household refrigeration appliance, the semitransparent cover is embodied to be semitransparent so that in the switched-off state the display or the input/display device does not appear or barely appears through the semitransparent cover. The semitransparent cover is therefore preferably embodied so that the information content displayed thereby is visible when the display or input/display device is switched on, when the display or input/display device is switched off, the entire display, where appropriate the entire input/display device is visually hidden, at least barely visible, behind the semitransparent cover. This can be achieved e.g. by selecting the printing or the film, in particular by selecting the thickness of the printing or the film.

In order to protect the display, in particular the input/display device, e.g. against moisture (condensation water, spillage into the recessed grip, etc.), a protective film can be provided which is fastened to the rear of the display or to the input/display device.

The surface of the semitransparent cover facing away from the display or the input/display device can preferably comprise a first surface which extends as far as the top front edge of the front panel and a second surface which adjoins the first surface and which extends as far as the top rear edge of the front panel and runs flush with the surface of the first region.

The depression with the display or the input/display device can be arranged below the first or the second surface, so that the displayed information contents are visible through the first or through the second surface. It is also possible, however, for the display or the input/display device to be arranged below the first and the second surface, so that displayed information contents are visible through the first and the second surface.

The first surface is preferably significantly larger than the second surface. The depression and thus the display or input/display device is preferably arranged only below the first surface of the semitransparent cover, so that the region below the second surface is free of the display or the input/display device.

The first surface and/or the second plane are preferably planar.

According to an embodiment of the inventive household refrigeration appliance, the first surface forms an oblique plane, which inclines from the second surface of the semitransparent cover as far as the top front edge. If the display or the input/display device is located below this inclined first surface, then the displayed information contents can be read out relatively well. The second surface preferably runs in a planar and horizontal manner and thus forms an edge with the first surface which is preferably designed to be planar.

According to a preferred embodiment of the inventive household refrigeration appliance, the first region comprises an upwardly oriented surface, which extends as far as the top rear edge and as far as the second region and runs flush with the second surface of the semitransparent cover. In particular, if this surface and the second surface are color matched to one another, it is therefore possible for the upwardly oriented surface of the first region and the second surface of the semitransparent cover to appear as a flush, continuous surface.

The upwardly directed surface preferably extends together with the second surface of the semitransparent cover across the entire width of the front panel. The upwardly directed surface and the second surface of the semitransparent cover are preferably oriented in a planar and/or horizontal manner.

According to an embodiment of the inventive household refrigeration appliance, provision can be made that after inputting the operating parameter and on account of the drawer being slid into the coolable interior space after the inputting process, a further input is automatically only possible on account of unblocking the input/display device. Therefore after inputting the operating parameter, the input is automatically blocked in order to prevent an accidental change in the operating parameter. If the operating parameter is to be changed, then the input/display device must be actively unblocked. If applicable an unblocking is already required when the drawer is opened or removed.

One exemplary embodiment of the invention is shown by way of example in the appended, schematic drawings.

DETAILED DESCRIPTION OF THE INVENTION

Figure 1:
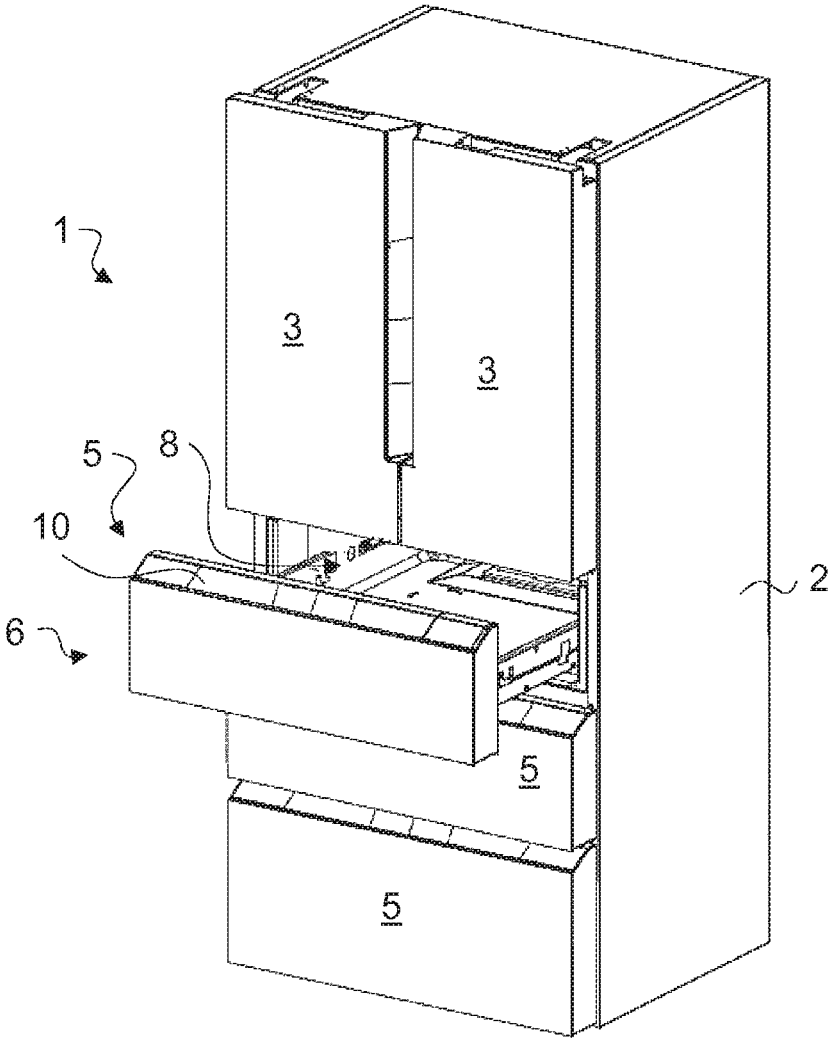
FIG. 1 shows a perspective representation of a household refrigeration appliance with a number of drawers, each of which comprises an input/display device which is covered by a semitransparent cover.
Figure 2:
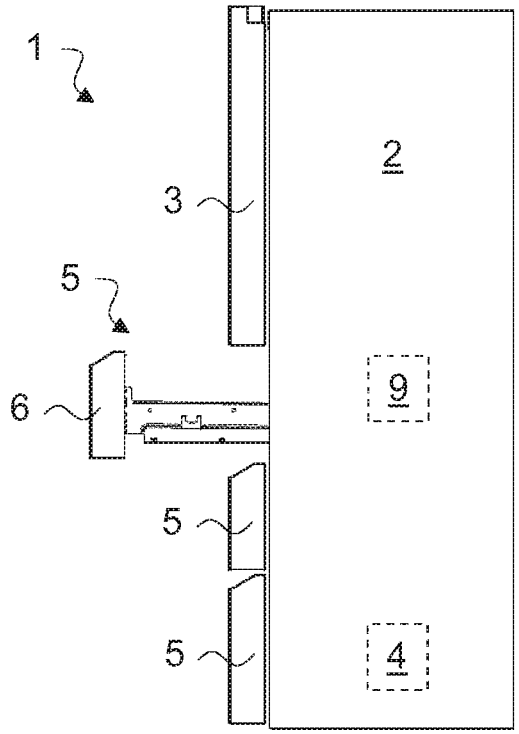
FIG. 2 shows a side view of the household refrigeration appliance.

FIG. 1 shows a perspective representation of a household refrigeration appliance 1 and FIG. 2 shows a side view of the household refrigeration appliance 1. In the case of the present exemplary embodiment the household refrigeration appliance 1 is a refrigerator-freezer.

The household refrigeration appliance 1 comprises a thermally-insulated body 2, which delimits coolable interior spaces provided for the storage of food. One of the coolable interior spaces can be opened and closed with two door leaves 3 arranged adjacent to one another and mounted pivotably with respect to the body 2, in particular with respect to vertically running pivot axes. This coolable interior space is in particular a refrigerating zone.

In the case of the present exemplary embodiment, the household refrigeration appliance 1 comprises a number of drawers 5 arranged one above the other below the refrigerating zone which can be closed with the door leaves 3, each of which comprises a front panel 6 with an input/display device 7. The input/display device 7 is covered with a semitransparent cover 16.

Figure 3:
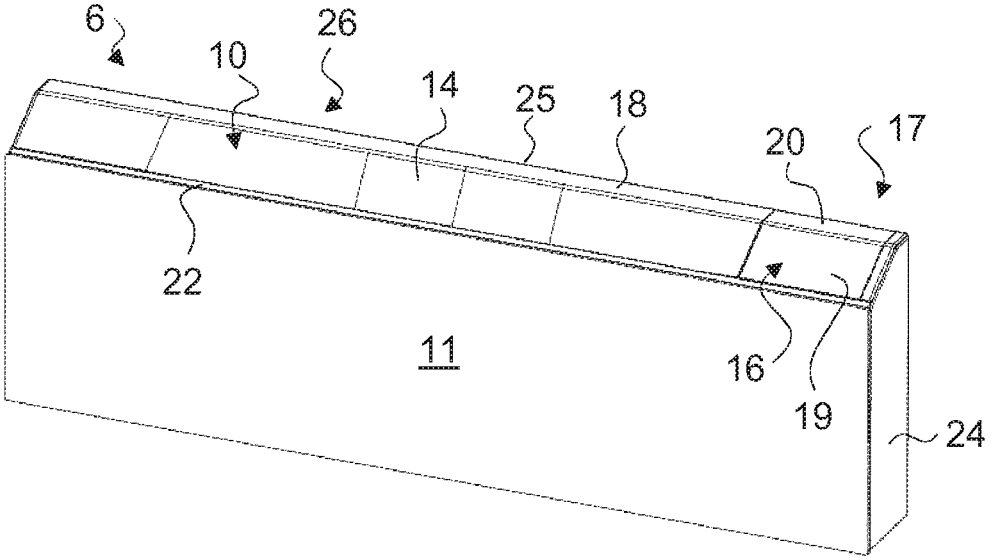
FIG. 3 shows the front panel in a perspective representation.
Figure 4:
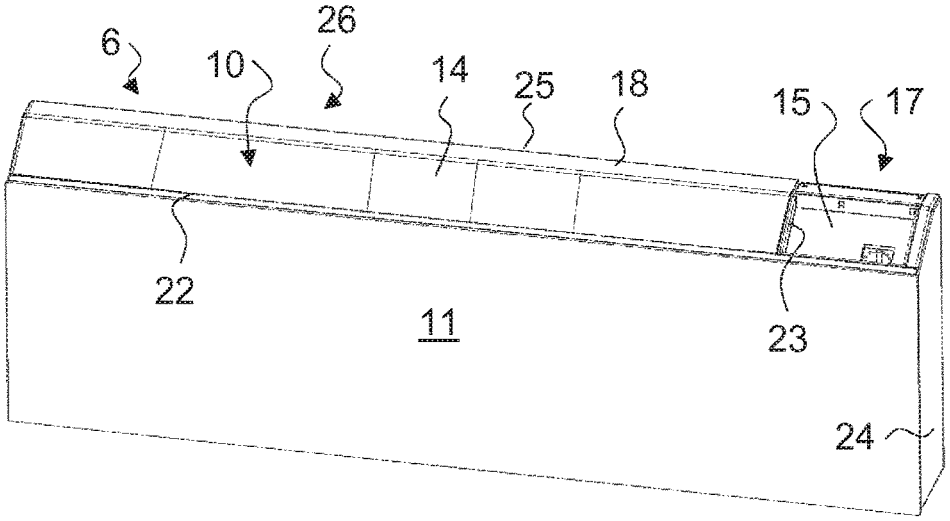
FIG. 4 shows the front panel in a perspective representation with a removed semitransparent cover and input/display device.
Figure 5:
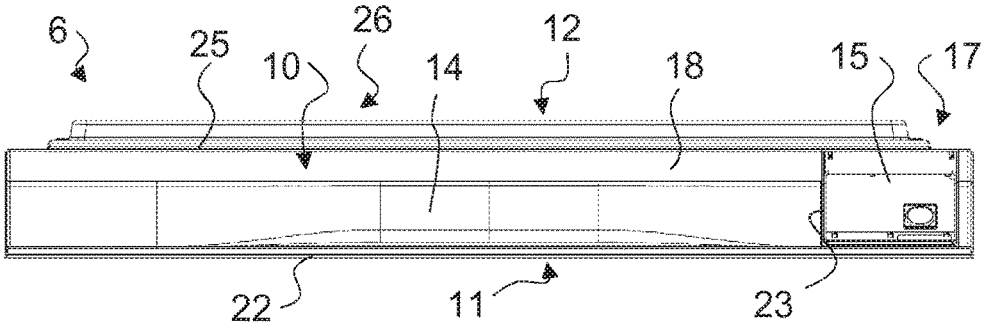
FIG. 5 shows a top view from above onto the front panel with a removed, semitransparent cover and input/display device.
Figure 6:
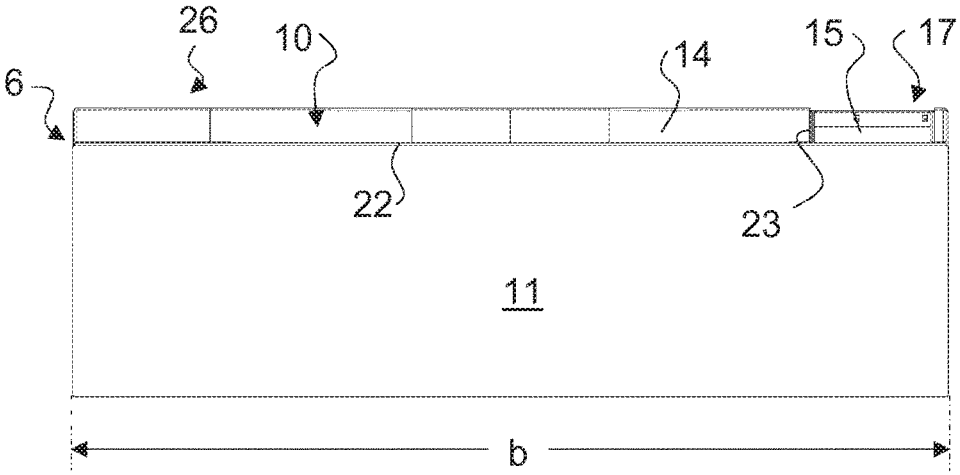
FIG. 6 shows a front view of the front panel with a removed, semitransparent cover and input/display device.
Figure 7:
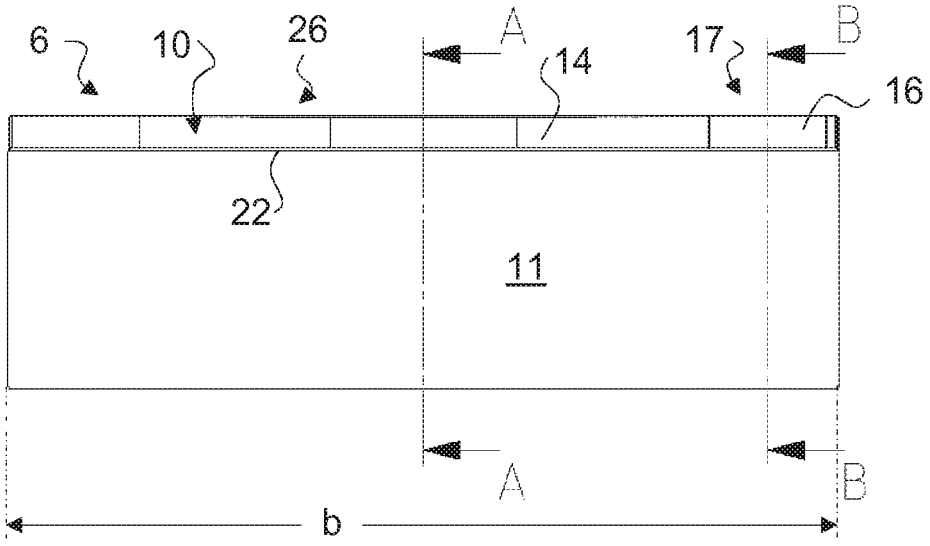
FIG. 7 shows a front view of the front panel with a semitransparent cover.
Figure 8:
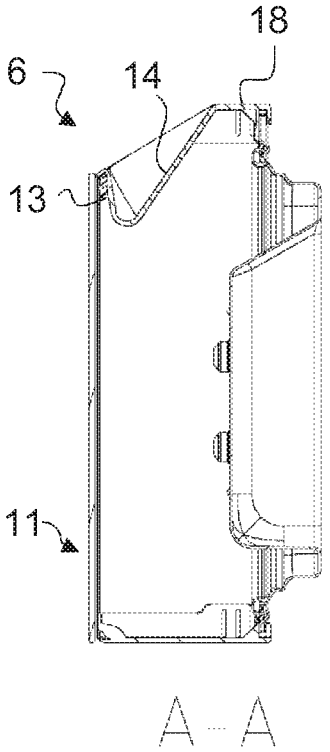
FIG. 8 shows a side view of the front panel in a cut-out representation along the line A-A in FIG. 7.
Figure 9:
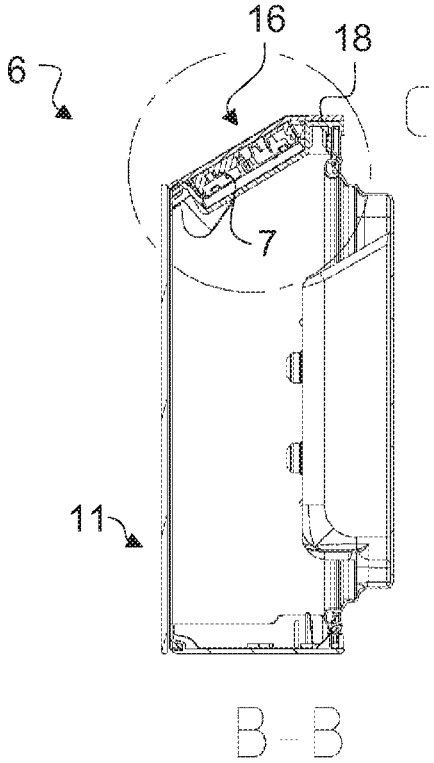
FIG. 9 shows a side view of the front panel in a cut-out representation along the line B-B in FIG. 7.
Figure 10:
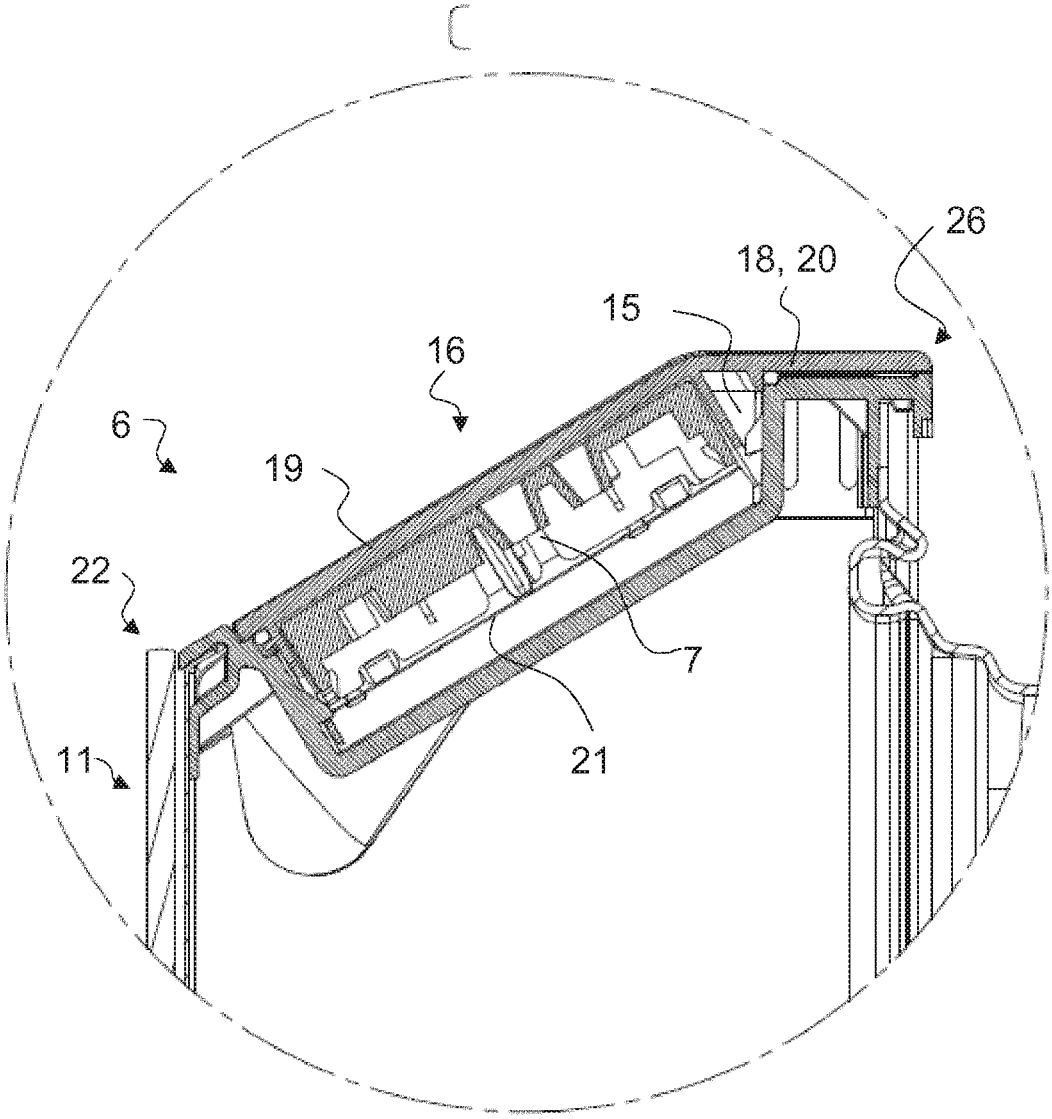
FIG. 10 shows a cutout of the representation of the front panel shown in FIG. 9.

FIG. 3 shows a perspective representation of the front panel 6, FIG. 4 shows a perspective representation of the front panel 6 with a removed semitransparent cover 16 and input/display device 7, FIG. 5 shows a top view from the top onto the front panel 6 with a removed semitransparent cover 16 and input/display device 7, FIG. 6 shows a front view of the front panel 6 with a removed semitransparent cover 16 and input/display device 7, FIG. 7 shows a front view of the front panel 6 with the semitransparent cover 16, FIG. 8 shows a cut-out representation along line A-A of FIG. 7 of a side view of the front panel 6, FIG. 9 shows a cut-out representation along line B-B of FIG. 7 of a side view of the front panel 6, and FIG. 10 shows a cutout of the representation of the front panel 6 shown in FIG. 9.

Further coolable interior spaces 8, which are in particular freezer zones, are assigned in each case to the drawers 5. The drawers 5 can be slid into these and at least partially pulled out from these. In the at least partially pulled-out state of the respective drawer 5, this can be loaded with food or food stored in this drawer 5 can be removed. In the slid-in state of the corresponding drawer 5, its front panel 6 closes its coolable interior spaces 8.

The front panel 6 comprises a front side 11 facing away from the coolable interior space 8, a rear side 12 facing the coolable interior space, two side flanks 24 connecting the front side 11 and the rear side 12, a top front edge 22 and a top rear edge 25.

In the case of the present exemplary embodiment, different refrigeration zones are assigned to the individual drawers 5 or their coolable interior spaces 8 in each case, the target temperatures of which can be set and displayed individually by means of their input/display devices 7 as an example of an operating parameter of the corresponding refrigerating zone or the corresponding coolable interior space 8.

FIGS. 1 and 2 show the topmost drawer 5 in the at least partially removed state and the two drawers 5 arranged therebelow in the slid-in state.

The front panels 6 each comprise a first region 26 which extends between the top front edge 22 and the top rear edge 25, with an upwardly opened recessed grip 10, with which the respective drawers 5 can be pulled at least partially out from the corresponding coolable interior space 8.

The household refrigeration appliance 1 comprises a refrigeration device 4 known essentially to the person skilled in the art, preferably in the form of a refrigerant circuit, which is configured to cool in particular the coolable interior spaces 8 assigned to the drawers 5 to temperatures which can be predetermined by means of the input/display device 7. The refrigerating zone which can be closed by the door leaves 3 is cooled to e.g. a temperature of e.g. 10° C. The coolable interior spaces 8 of the drawers 5 are cooled in particular to freezer temperatures of clearly below 0° C.

In the case of the present exemplary embodiment, the household refrigeration appliance 1 comprises an electronic control device 9 which is configured to control the refrigeration device 4, in particular the compressor of the refrigerant circuit in a manner that is commonly known to the person skilled in the art, such that the coolable interior spaces 8 of the drawers 5 and the refrigerating zone have at least approximately their predetermined target temperatures. The electronic control device 9 is preferably designed so that it controls the temperatures. In order, where appropriate, to obtain the actual temperatures of the coolable interior spaces 8 of the drawers 5 and the refrigerating zone, the household refrigeration appliance 1 can have temperature sensors, not shown in more detail, which are connected to the electronic control device 9. The electronic control device 9 is connected to the input/display devices 7.

The front panels 6 in each case comprise a second region 17 which extends between the top front edge 22 and the top rear edge 25 and is arranged adjacent to the first region 26 or adjacent to the recessed grip 10. In the case of the present exemplary embodiment, the second region 17 extends as far as one of the side flanks 24 and the first region 26 and the recessed grip 10 extends as far as the other side flank 24.

A depression 15, in which the input/display device 7 is arranged, is provided in the second region 17. The second region 17 comprises the semitransparent cover 16, which covers the complete second region 17, through which appear information contents displayed by the input/display device 7 in the switched-on state.

The input/display device 7 is preferably designed as a touchscreen, which preferably comprises a "slider" function. Provision can also be made to provide a time lapse display with "fade in/out" of LEDs arranged in a light line.

In the case of the present exemplary embodiment, the extent of the first region 26 and the recessed grip 10 along the width b of the front panel 6 is significantly larger than the second region 17 of the front panel 6.

In the case of the present exemplary embodiment, the recessed grip 10 comprises a front, rearwardly engageable wall section 13 and a recessed grip section 14 which passes into the wall section 13 and extends in an oblique manner. The surface of the obliquely extending recessed grip region 14 can be planar or curved, in particular concave. The rearwardly engageable wall section 13 extends as far as the top front edge 22 of the front panel 6.

In the case of the present exemplary embodiment, the surface of the semitransparent cover 16 which faces away from the input/display device comprises a first surface 19 extending as far as the top front edge 22 of the front panel 6 and a second surface 20 adjoining the first surface 19 and extending as far as the top rear edge 25 of the front panel 6.

The depression 15 with the input/display device 7 can be arranged below the first or the second surface 19, 20, so that the displayed information contents are visible through the first or through the second surface 19, 20. It is also possible, however, for the input/display device 7 to be arranged below the first and the second surface 19, 20 so that displayed information contents are visible through the first and the second surface 19, 20.

In the case of the present exemplary embodiment, the depression 15 and the input/display device 7 is arranged below the first surface 19 so that the information contents are only visible through the first surface 19.

The first surface 19 is preferably clearly larger than the second surface 20 and the first surface 19 and the second surface 20 are in particular planar.

In the case of the present exemplary embodiment, the first surface 19 forms an oblique plane, which inclines from the second surface 20 of the semitransparent cover 16 as far as the top front edge 22.

In the case of the present exemplary embodiment, the first region 26 comprises an upwardly oriented surface 18, which extends as far as the top rear edge 26 and the second region 17 and runs flush with the second surface 20 of the semitransparent cover 16. The surface 18 and the second surface 20 are color matched to one another.

The upwardly directed surface 18 together with the second surface 20 of the semitransparent cover 16 preferably extends across the entire width b of the front panel 6. The upwardly directed surface 18 and the second surface 20 of the semitransparent cover 16 are preferably planar and/or run horizontally.

The upwardly directed surface 18 of the first region can also be arched, in particular convex and adjoins in particular the obliquely running recessed grip section 14.

In the case of the present exemplary embodiment, the first region 26 with the recessed grip 10 is made from plastic and its surface is lacquered.

In the case of the present exemplary embodiment, the first region 26 and the second region 17 are separated by a wall 23.

The semitransparent cover 16 is further designed so that through this appear information contents displayed by the input/display device 7 in the switched-on state, in other words can be identified or read by a person.

In the case of the present exemplary embodiment, the semitransparent cover 16 is manufactured from a plastic which is transparent to light, in particular polymethylmethacrylate (PMMA), and, in the case of the present exemplary embodiment, is printed or provided with a film in order to have the desired property which is semitransparent to light. The surface of the semitransparent cover 16 facing the input/output device 7 is printed or provided with the film.

The semitransparent cover 16 is preferably fastened to the input/display device 7, in particular by means of a catch mechanism.

The semitransparent cover 7 with input/display device 7 fastened thereto is preferably fastened to the front panel 6 by means of a catch mechanism.

At least in the region of the second surface 20, the color of the printing or the film of the semitransparent cover 16 is selected so that it corresponds to the color of the upwardly directed surface 18.

Furthermore, in the case of the present exemplary embodiment, provision is made for the semitransparent cover 16 to be embodied to be semitransparent so that the input/display device 7, in the switched off state, does not appear through or at least barely through the semitransparent cover 16, in the switched on state however the displayed information contents are visible. In the case of the present exemplary embodiment, this is achieved by suitably selecting the printing or the film.

In the case of the present exemplary embodiment, a protective film 21 is provided, which is fastened to the rear of the input/display device 7.

In the case of the present exemplary embodiment, the household refrigeration appliance 1 or the input/display device 7 is embodied so that after inputting the operating parameter, in the case of the present exemplary embodiment of the target temperature and on account of the corresponding drawer 5 sliding into the coolable interior space 8 after the inputting process, a further input is automatically only possible on account of blocking the input/display device 7.

The household refrigeration appliance 1 or the front panel 6 of the drawer 5 were in particular produced by the input/display device 7 initially having been fastened to the semitransparent cover 16, in particular by means of a catch mechanism, the semitransparent cover 16 with the input/display device 7 fastened thereto likewise having been fastened to the front panel 6 by means of a catch mechanism.

LIST OF REFERENCE CHARACTERS

1 household refrigeration appliance
2 thermally insulated body
3 door leaves
4 refrigeration device
5 drawers
6 front panel
7 input/display device
8 coolable interior spaces
9 electronic control device
10 recessed grip
11 front side
12 rear side
13 rearwardly engageable wall section
14 recessed grip section
15 depression
16 semitransparent cover
17 second region
18 surface
19 first surface
20 second surface
21 protective film
22 top front edge
23 wall
24 side flanks
25 top rear edge
26 first region
b width

The invention claimed is:

1. Household refrigeration appliance, comprising:

a thermally-insulated body delimiting a coolable interior space;

a refrigeration device for cooling said coolable interior space;

a drawer to be slid into said coolable interior space and at least partially pulled out from said coolable interior space for loading and unloading food, said drawer including a front panel closing said coolable interior space upon sliding said drawer into said coolable interior space;

said front panel having a front side facing away from said coolable interior space, a rear side facing towards said coolable interior space, two side flanks, a top front edge, a top rear edge, a first region extending between said top front and top rear edges, a second region disposed adjacent said first region, extending obliquely relative to said first region and extending between said top front and top rear edges, said first region having an upwardly opened recessed grip formed therein, said grip having a grip portion being inclined between said top front edge and top rear edge said first region having a surface, and a display disposed in a depression formed on said front panel; and a semitransparent cover completely covering said second region and permitting information contents displayed by said display in a switched on state to appear through said semitransparent cover, and said semitransparent cover having a cover surface facing away from said display, said cover surface running at least partially flush with said surface of said first region, said cover surface having a first cover surface portion being inclined between said top front edge and top rear edge at a different angle than said grip portion.

2. The household refrigeration appliance according to claim 1, wherein said semitransparent cover completely covers said second region, and has a second cover surface portion adjoining said first cover surface portion and extending as far as said top rear edge of said front panel and running flush with an adjacent portion of said surface of said first region, said first and second cover surface portions extending obliquely relative to each other.

3. The household refrigeration appliance according to claim 2, wherein said first cover surface portion defines an oblique plane being inclined from said second cover surface portion of said semitransparent cover as far as said top front edge.

4. The household refrigeration appliance according to claim 2, wherein said adjacent portion of said surface of said first region is upwardly directed and extends as far as said top rear edge and said second region and runs flush with said second surface portion of said semitransparent cover.

5. The household refrigeration appliance according to claim 4, wherein said adjacent portion and said second cover surface portion extend together across an entire width of said front panel or are planar.

6. The household refrigeration appliance according to claim 2, wherein at least one of said first cover surface portion or said second cover surface portion is planar.

7. The household refrigeration appliance according to claim 2, wherein said first cover surface portion is at least one of larger than said second cover surface portion or disposed above said depression and said display.

8. The household refrigeration appliance according to claim 1, wherein said semitransparent cover and said first region are at least one of formed of different materials or color matched to one another.

9. The household refrigeration appliance according to claim 1, wherein said semitransparent cover is at least one of formed of polymethylmethacrylate or has a surface facing said display being printed or provided with a film to obtain a semitransparent property of said semitransparent cover.

10. The household refrigeration appliance according to claim 1, wherein said semitransparent cover has a semitransparency causing said display to not appear through or at least hardly appear through said semitransparent cover.

11. The household refrigeration appliance according to claim 1, wherein said first region and said recessed grip at least one of extend across a wider region of a width of said front panel than said second region or extend across a majority of said width of said front panel.

12. The household refrigeration appliance according to claim 1, wherein said second region extends as far as one or another of said side flanks of said front panel.

13. The household refrigeration appliance according to claim 1, which further comprises a protective film fastened to a rear of said display.

14. The household refrigeration appliance according to claim 1, wherein said display is part of an input/display device configured for setting and displaying an operating parameter of said coolable interior space assigned to said drawer.

15. The household refrigeration appliance according to claim 14, wherein said input/display device is configured to automatically only permit a further input by unblocking said input/display device after inputting the operating parameter and sliding said drawer into said coolable interior space after inputting the operating parameter.

16. A method for producing a household refrigeration appliance, the method comprising:

providing the household refrigeration appliance according to claim 1;

fastening said display to said semitransparent cover, and fastening said semitransparent cover with said display fastened thereto to said front panel causing said display to be disposed in said depression and causing said semitransparent cover to completely cover said second region.

17. The household refrigeration appliance according to claim 1, wherein said second region has said depression and said display disposed in said depression.

18. The household refrigeration appliance according to claim 1, wherein said grip portion is inclined at a steeper angle than said first cover surface portion.

19. A household refrigeration appliance, comprising:

a thermally-insulated body delimiting a coolable interior space;

a refrigeration device for cooling said coolable interior space;

a drawer to be slid into said coolable interior space and at least partially pulled out from said coolable interior space for loading and unloading food, said drawer including a front panel closing said coolable interior space upon sliding said drawer into said coolable interior space;

said front panel having a front side facing away from said coolable interior space, a rear side facing towards said coolable interior space, two side flanks, a top front edge, a top rear edge, a first region extending between said top front and top rear edges, a second region disposed adjacent said first region, extending obliquely relative to said first region and extending between said top front and top rear edges, said first region having an upwardly opened recessed grip formed therein, said first region having a surface, and a display disposed in a depression formed on said front panel;

a semitransparent cover completely covering said second region and permitting information contents displayed by said display in a switched on state to appear through said semitransparent cover, and said semitransparent cover having a surface facing away from said display, said surface running at least partially flush with said surface of said first region, said semi-transparent cover having a sealing ring for protecting said display from humidity.

* * * * *